US010886094B2

(12) United States Patent
Fox

(10) Patent No.: US 10,886,094 B2
(45) Date of Patent: Jan. 5, 2021

(54) ELECTRON TUBE

(75) Inventor: David Bernard Fox, Chelmsford (GB)

(73) Assignee: TELEDYNE UK LIMITED, Chelmsford (GB)

( * ) Notice: Subject to any disclaimer, the term of this patent is extended or adjusted under 35 U.S.C. 154(b) by 1184 days.

(21) Appl. No.: 13/698,920

(22) PCT Filed: May 11, 2011

(86) PCT No.: PCT/GB2011/050897
§ 371 (c)(1),
(2), (4) Date: Jan. 31, 2013

(87) PCT Pub. No.: WO2011/144918
PCT Pub. Date: Nov. 24, 2011

(65) Prior Publication Data

US 2013/0221844 A1 Aug. 29, 2013

(30) Foreign Application Priority Data

May 18, 2010 (GB) ..... 1008263.4

(51) Int. Cl.
*H01J 23/12* (2006.01)
*H01J 25/587* (2006.01)

(52) U.S. Cl.
CPC ..... *H01J 23/12* (2013.01); *H01J 25/587* (2013.01)

(58) Field of Classification Search
USPC ..... 315/39.51, 39.53, 39.55, 39.71, 39.75; 313/159, 160, 255
See application file for complete search history.

(56) References Cited

U.S. PATENT DOCUMENTS 3,361,930 A * 1/1968 Blank ..... H01T 1/00 313/325
4,142,022 A * 2/1979 Erickson ..... B32B 7/04 428/432
4,310,786 A * 1/1982 Kumpfer et al. ..... 315/39.51
4,652,788 A * 3/1987 Lauche ..... H01J 9/125 313/103 CM (Continued)

FOREIGN PATENT DOCUMENTS

CN 201374305 Y 12/2009
GB 745729 A 2/1956

(Continued)

OTHER PUBLICATIONS

International Search Report of PCT/GB2011/050897 dated Sep. 13, 2011.

(Continued)

*Primary Examiner* — Amy Cohen Johnson
*Assistant Examiner* — James H Cho
(74) *Attorney, Agent, or Firm* — FisherBroyles, LLP; Robert Kinberg

(57) ABSTRACT

A high power electron tube, such as a magnetron, has the disadvantage that, to reduce the chances of the ceramic RF window failing in use, the manufacturing step entails a prolonged ageing period of powering the magnetron at low power on test, in order to drive any absorbed gases out of the RF window. According to the invention, the RF window 6 is internally glazed (8), which makes it possible to avoid the ageing period.

13 Claims, 1 Drawing Sheet

(56) References Cited

U.S. PATENT DOCUMENTS

| | | | | |
|---|---|---|---|---|
| 5,939,831 | A * | 8/1999 | Fong | C23C 16/4405 134/1.1 |
| 5,998,934 | A * | 12/1999 | Mimasu et al. | 315/118 |
| 6,132,551 | A * | 10/2000 | Horioka | H01J 37/321 156/345.48 |
| 7,462,978 | B1 * | 12/2008 | Schmitkons et al. | 313/232 |
| 2005/0061807 | A1 * | 3/2005 | Cotten et al. | 219/688 |
| 2006/0220566 | A1 * | 10/2006 | Brady | 315/39.51 |
| 2006/0280290 | A1 * | 12/2006 | Matsumura et al. | 378/140 |
| 2008/0164148 | A1 * | 7/2008 | Bley | 204/416 |
| 2008/0309239 | A1 * | 12/2008 | Kasai et al. | 315/39.51 |
| 2010/0102408 | A1 * | 4/2010 | Suyama et al. | 257/429 |
| 2011/0012508 | A1 * | 1/2011 | Leonhardt | 315/39 |

FOREIGN PATENT DOCUMENTS

| | | | |
|---|---|---|---|
| GB | 1084208 | A | 9/1967 |
| GB | 2297190 | A | 7/1996 |
| GB | 2424753 | A | 10/2006 |
| JP | 44-025665 | * | 10/1969 |
| JP | 44-25665 | B2 | 3/2010 |

OTHER PUBLICATIONS

Chinese Office Action dated Jan. 21, 2015, issued in corresponding Chinese Application No. 201180021427.4. (English Translation).

Japanese Office Action dated Feb. 18, 2015, issued in corresponding Japanese Application No. 2013-510680.

Glass, Chemistry Explained, www.chemistryexplained.com/Ge-Hy/Glass.html, accessed Apr. 6, 2017.

Brueckner, R., Properties and Structure of Vitreous Silica I, Journal of Non-Crystalline Solids, vol. 5, Issue 2, Nov. 1970, pp. 123-175.

* cited by examiner

ELECTRON TUBE

The invention particularly relates to the RF windows of electron tubes, especially but not exclusively magnetrons. The electron tubes pass RF/microwave energy from a vacuum environment to an air/gaseous environment through the RF window.

FIG. 1 is a front view, partly in section, of a magnetron. A hollow cylindrical anode 1 surrounds an axially extending cathode 2, which is supplied with a high negative voltage, as well as a voltage to heat the cathode, by means of leads housed in a sidearm 3 which bears supply terminals (not shown). The output of the magnetron is radiated from antenna 4, for example, along a waveguide 5, and the antenna extends into the interaction region between the cathode and the anode. An RF output window 6, in the form of a ceramic dome, encloses the antenna in the vacuum enclosure.

A problem which has been encountered with high power, such as 100 kW magnetrons operated in continuous wave (CW) mode is that of cracking of the RF window in operation of the valve, resulting in loss of vacuum and failure of the device. The reasons for this problem are not fully understood, but one possible explanation is that glow discharge takes place in gas released from the ceramic dome as it becomes heated by the radiating RF/microwave power, which causes localised heating of the dome. Alternatively, heating may be clue to a multipactor discharge on the surface of the window, which could in itself cause gas release from the ceramic dome.

The usual method of counteracting this problem is to run the magnetrons for a long period, such as 24 hours, at low power, before operating them at peak power. It is thought that any gases absorbed in the ceramic dome would be released over this period but without gas discharge being able to take place because of the low power output. Then full power can be applied without the risk of gas discharge taking place.

While this has greatly reduced the incidence of such catastrophic failures in use, the low power ageing operation is a time-consuming step in the manufacture of the magnetron.

The invention provides an electron tube having an RF output window of ceramic material, in which the window has a coating of glass on the inner surface.

This reduces or eliminates the need for the very long preliminary period of low power operation.

The RF window may be bonded to the body of the electron tube at a region of metallisation, and the inner surface of the window is advantageously free of glazing in an adjoining region. The adjoining region may be chamfered to be free of the glazing.

The RF window may be made of alumina, and the glass is advantageously high temperature glass, preferably becoming mobile at above 1500 degrees centigrade. The glass may be borosilicate glass. The thickness of the glass layer is preferably within the range of from 0.05 mm to 3 mm.

One way of carrying out the invention will now be described in detail, by way of example, with reference to the accompanying drawings, in which.

Figure 1:
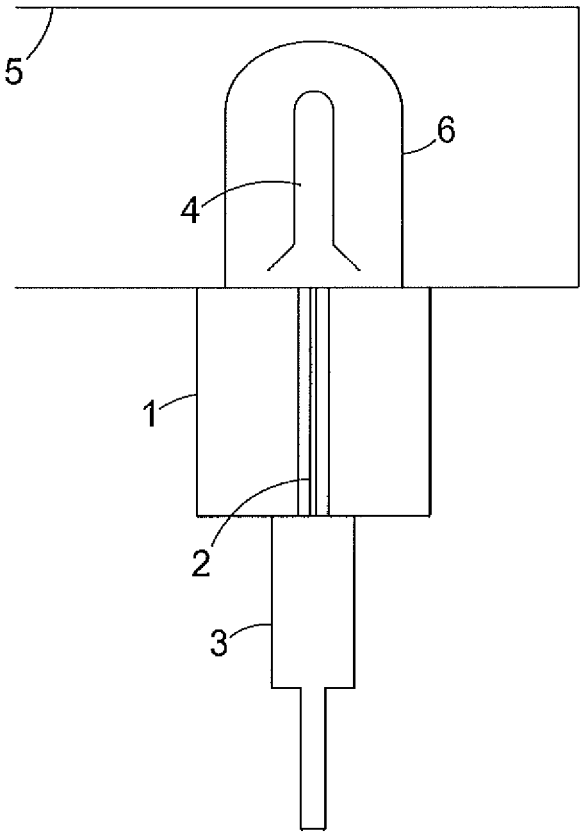
FIG. 1 is a schematic front view, partly in section, of a known magnetron.

The magnetron of the invention differs from known magnetrons of the type described with reference to FIG. 1 only in the construction of the RF output window.

Figure 2:
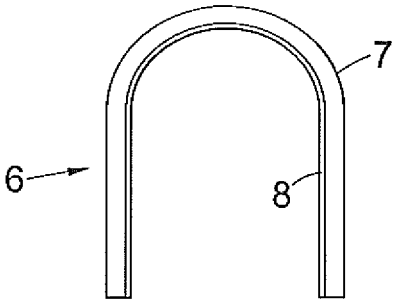
FIG. 2 is a sectional view (not to scale) of an RF output window of a magnetron according to the invention.
Figure 3:
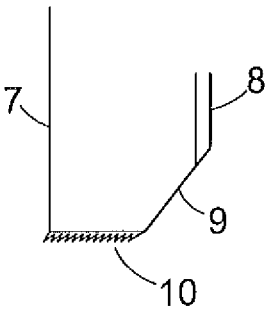
FIG. 3 is an enlarged fragmentary view (not to scale) of a part of the window shown in FIG. 2.

Referring to FIG. 2, the RF output window indicated generally by the reference numeral 6 is fabricated from a dome 7 of ceramics material (as in FIG. 1) but having an internal layer of glass 8. Referring to FIG. 3, the internal rim of the dome is chamfered by means of a grinding operation at region 9. In addition, the underside of the rim is also ground, as this surface is to form a base for metallising paint 10, which is bonded to the surface at high temperatures in a metallising process. This surface is subsequently brazed to the metal body of the magnetron during assembly. The glass-free margin 9 produced by the grinding ensures that the glass layer cannot interfere with the subsequent metallising process.

In practice, the glazing may be applied so as to terminate a little short of the bottom of the dome, because of the need to keep the glass clear of the base during the high temperatures of the metallising operation. Neverthelesss, the grinding step is advisable, because glazing has a tendency to spread during its firing, and there is a risk that it could have spread right down to the base of the dome.

Because of the subsequent metallising operation, the glass coating is high temperature glass, that is, it becomes mobile at above 1500 degrees centigrade. In addition, the glass must have low RF loss, although this is unlikely to be a problem, since the coating is thin. The glass must also have a coefficient of expansion which is compatible with that of the material of the dome.

A suitable ceramics material is alumina ($Al_2O_3$), preferably of purity better than 90% to ensure low loss to the transmitted RF. A suitable glass layer is borosilicate glass. However, other high temperature glass coatings could also be used, and other ceramics materials with low RF loss could also be used.

It has been found that the internally glazed domes are not prone to the catastrophic failure sometimes encountered with prior art magnetrons, even though they have not been subject to the low power ageing operation. The reason for this is not fully understood, but it may be because the glaze prevents the discharge of gas from the alumina. However, glass is less prone to multipactor, and the catastrophic failures may not take place for this reason, alternatively, or in addition.

The ceramic thickness is typically approximately 6 mm and the glaze coating approximately 0.2111111.

If desired, the ceramic window could be glazed on its internal and external surfaces. The glaze on the external surface would play no part in preventing the discharge, but it would not be a disadvantage. There is, of course, no need for the RF window to be dome-shaped. The glazed interior can be used on any shape of RF window, including a flat shape.

Although the invention has been described in relation to a magnetron, the glazed RF window could also be applied to other types of electron tubes, such as inductive output tubes, klystrons, travelling wave tubes, or gyro-travelling wave amplifiers. The technique can be used in any situation where there is a window that passes RF/microwave energy from a vacuum environment to an air/gaseous environment, and is particularly useful where the frequency and power combine to produce some form of discharge. Thus, the invention is useful for high power tubes where the RF output power exceeds 50 kW, especially where it exceeds 75 kW, particularly when operated in continuous wave mode. This is especially true at high frequencies in excess of 1 GHz, where the area of the window is likely to be smaller, for example for frequencies in the range 1 GHz to 20 GHz, more particularly, 1 GHz to 3 GHz.

The invention claimed is:

1. An electron tube having an RF output window of ceramic material having an inner surface, the RF output window being arranged to pass RF energy from a vacuum environment in the electron tube to a gaseous environment outside the electron tube, wherein the RF output window includes an electrically insulating glass coating on the inner surface of the ceramic material.

2. The electron tube as claimed in claim 1, in which a periphery of the RF output window is free of the electrically insulating lass coating.

3. The electron tube as claimed in claim 2, in which the periphery of the RF output window has been ground to ensure it is free of the electrically insulating glass coating.

4. The electron tube as claimed in claim 3, in which the periphery of the RF output window is chamfered.

5. The electron tube as claimed in claim 3, in which a region of the RF output window adjacent to the periphery of the RF output window that has been ground is metallised.

6. The electron tube as claimed in claim 1, in which the coating is of a high temperature glass.

7. The electron tube as claimed in claim 1, in which the glass is borosilicate glass.

8. The electron tube as claimed in claim 1, in which the thickness of the coating lies between 0.05 mm and 3 mm.

9. The electron tube as claimed in claim 8, in which the thickness of the coating is approximately 0.2 mm.

10. The electron tube as claimed claim 1, in which the ceramic material is alumina.

11. The electron tube as claimed in claim 1, in which the electron tube is a magnetron.

12. The electron tube as claimed in claim 11, in which the RF output window is dome-shaped.

13. A method of making an RF output window suitable for use in the electron tube according to claim 1.

* * * * *